United States Patent [19]

Baynes et al.

[11] Patent Number: 4,672,158

[45] Date of Patent: Jun. 9, 1987

[54] MULTIPLE CONTACT SWITCH

[75] Inventors: Jerre E. Baynes, Ellisville, Mo.; Nick L. Knepple, Indianapolis, Ind.

[73] Assignee: AT&T Company and AT&T Technologies, Inc., Murray Hill, N.J.

[21] Appl. No.: 814,860

[22] Filed: Mar. 10, 1986

Related U.S. Application Data

[62] Division of Ser. No. 647,562, Sep. 5, 1984, Pat. No. 4,580,017.

[51] Int. Cl.[4] ..... H01H 1/32

[52] U.S. Cl. ..... 200/283

[58] Field of Search ..... 200/283, 284, 272; 339/59 M, 59 R

[56] References Cited

U.S. PATENT DOCUMENTS

| | | | |
|---|---|---|---|
| 3,235,830 | 2/1966 | Newton, Jr. | 339/59 M |
| 3,750,060 | 7/1973 | Pfenning | 200/283 |
| 3,771,102 | 11/1973 | Murray et al. | 200/283 |
| 3,842,231 | 10/1974 | Schedele et al. | 200/283 |
| 4,032,739 | 6/1977 | Nicolaisen et al. | 200/283 |
| 4,557,542 | 12/1985 | Coller et al. | 339/59 M |

*Primary Examiner*—Stephen Marcus
*Assistant Examiner*—Renee S. Luebke
*Attorney, Agent, or Firm*—R. F. Kip, Jr.; Harry L. Newman

[57] ABSTRACT

There is disclosed a multiple electrical contact switch which has a comb block whose teeth are inserted into receptacles of a mounting block thereby wedging pairs of electrical spring contacts, which are also inserted into the receptacles, between the teeth and the receptacles without bending the spring contacts. The electrical contacts extend from the receptacles and are activated by an operating card, which engages the extended portions of the electrical contacts to open or close electrical conduction paths. When pressure on the spring contacts from the actuating card is released, the spring contacts then move the operating card to an original position wherein the sequence of open and closed contact springs is as if there were no contact with the operating card and the contact springs.

1 Claim, 13 Drawing Figures

MULTIPLE CONTACT SWITCH

This is a division of application Ser. No. 647,562 filed Sept. 5, 1984, now U.S. Pat. No. 4,580,017.

TECHNICAL FIELD

This invention relates generally to electro-mechanical multiple electrical contact switches. More specifically, this invention relates to switches of such kind having switch elements which have spring contacts, uses a minimum number of parts, and can be made readily mountable on printed wiring boards.

BACKGROUND OF THE INVENTION

This invention is addressed to the problem of providing a multiple electrical contact switch with a minimum number of parts capable of responding to the vertical movement of an actuator such as the vertical releasing movement of a push button on a telephone set. Such response can be the opening or the closing of electrical switches from either closed or open positions respectively.

A recent development (Van Cleave et al. U.S. Pat. No. 4,319,102) in electro-mechanical multiple contact switches uses wedges to hold spring contacts in place and operating cards to move the spring contacts to break electrical contact. More specifically, Van Cleave has two blocks which, when one block is inserted into the other, wedge a combed spring contact in place. The teeth of the combed contact are made of an electrical conducting material, and each tooth is one of two conductive parts that make or break contact to perform the switching operation. In the operating card there is a sequence of holes which are positioned at preset locations on the card. When the operating card is inserted below the combed spring contact, the individual teeth are separated from other conductive parts below the card to break electrical contact. However, if there is a hole between the tooth and the corresponding conductive piece, electrical contact is not broken.

Van Cleave is, however, not without its shortcomings. The wedging action in Van Cleave results in bending of the spring contacts possibly precluding their further use. In addition, Van Cleave only discloses a method of sequentially opening a set of switches which are all originally in the closed position. Furthermore, the operating card must be pulled out of position to return all the spring contacts to their original position or rest position wherein the sequence of open and closed contacts acts as if there were no card in contact with the spring contacts. Therefore, if one needed to have the card return to an original position without manually pulling the card, extra springs and parts to locate these extra springs would be necessary. These latter named parts are now used in telephone sets, so that the card can return to its original position when the telephone receiver is off hook.

While there are devices which will put contacts in any sequence of open or closed contacts from any other preset sequence, these devices contain many operating parts. For example, one of the latest developments (Summers U.S. Pat. No. 3,742,485) uses threaded screws, spring biased double throw microswitches with lever arms, a chassis box with four guide plates to hold the microswitches and an operating card.

There is, therefore, a need for a multiple contact switch which will change any preset sequence of opened and closed electrical contacts to any other sequence and return to the preset or original sequence, using a minimum number of parts resulting in reduced costs and ease of assembly.

SUMMARY OF THE INVENTION

The foregoing need is satisfied according to the invention hereof in one of its aspects by providing a contact switch comprising insulative contact mounting means having at least one receptacle into which there is inserted a pair of spring contacts, insulative tapered means inserted into the receptacle to wedgingly hold both spring contacts fixed in the receptacle such that the spring contacts can make and break contact, and an operating card wherein the leading edges contact the spring contacts to produce any desired end combination of open and closed contacts.

According to another of its aspects, the invention comprises spring contact holding means, an array of pairs of spring contacts held by such means and an operating card movable between rest and operating positions so as to close and open ones of such pairs of contacts, and at least one such contact being adapted after being resiliently deflected by such card to restore it to rest position.

Thus, a multiple contact switch according to the invention requires only a minimum number of parts since the pairs of spring contacts are simply held in place by the wedging action of joining two simple blocks, or of an insulative contact mounting means and an insulative tapered means. Furthermore, the contact springs serve a dual function of electrical switching and of providing the necessary force to return the operating card to a rest position wherein the multiple contact switch acts as if there were no contact between the operating card and the spring contacts.

BRIEF DESCRIPTION OF THE DRAWINGS

For a better understanding of the invention, reference is made to the following description of an exemplary embodiment thereof, and to the accompanying drawings wherein.

EMBODIMENT OF THE INVENTION

Figure 1:
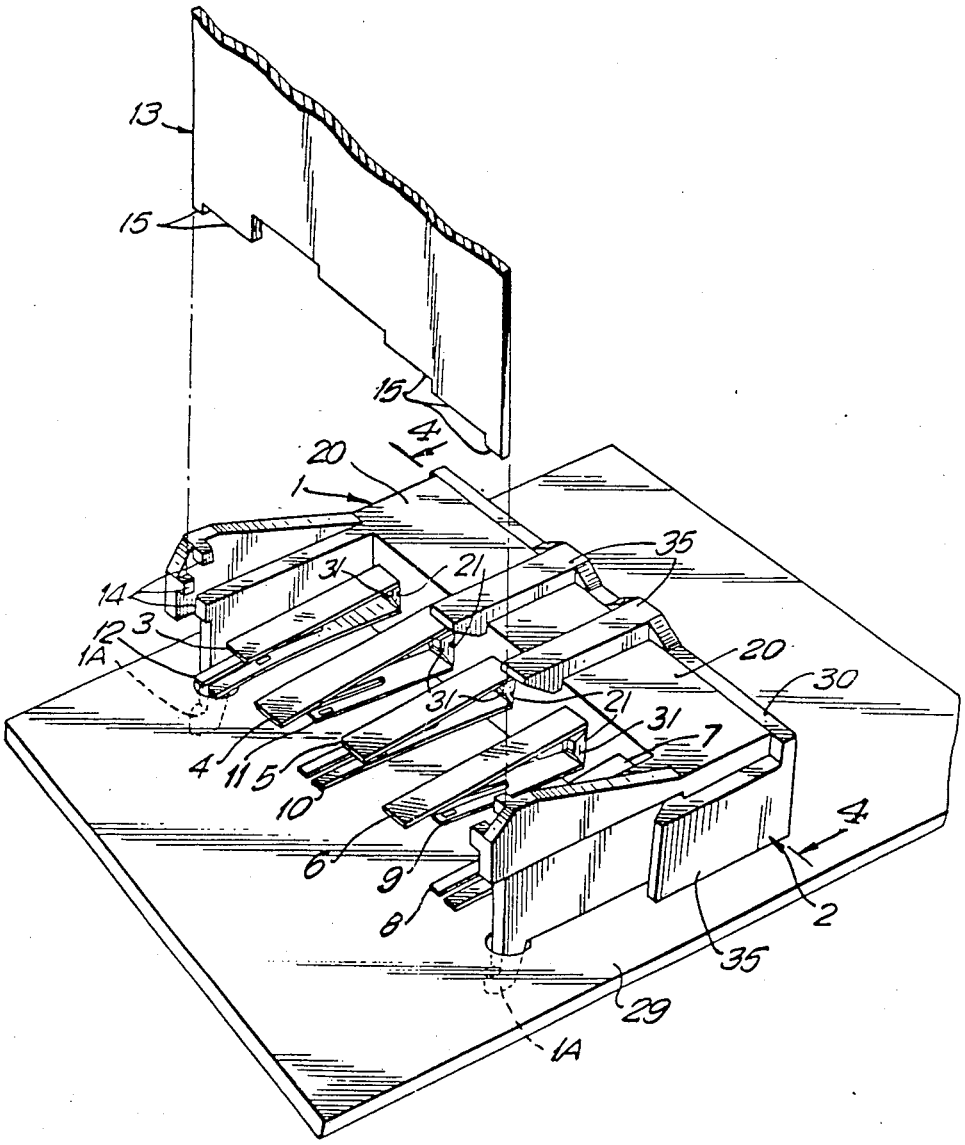
FIG. 1 is an isometric view of multiple electric contact switch apparatus according to the invention.

Referring to FIG. 1, the mounting block 1 has a laterally extending crosshead 20 in which is formed an array of laterally spaced receptacles 21 extending longitudinally through head 20 and each bounded on its interior by laterally spaced vertical longitudinally extending sidewalls which divergently taper away from each other in the direction from the front of head 20 to the rear thereof, and by top and bottom transversely spaced longitudinally extending planar walls which also divergently taper away from each other in the same manner as the sidewalls.

Figure 8A:
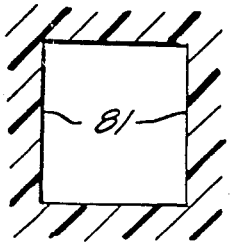
FIGS. 8A, 8B and 8C are transverse-lateral schematic cross sections through the receptacles of the mounting block at various positions from front to rear, respectively, such cross sections being taken as indicated by the arrows 8A—8A, 8B—8B and 8C—8C in FIG. 5.
Figure 8B:
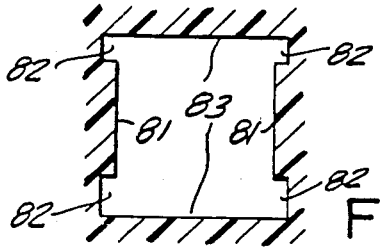
Figure 8C:
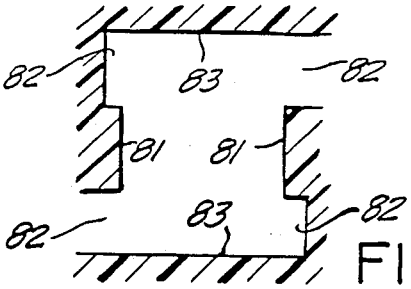
Figure 8D:
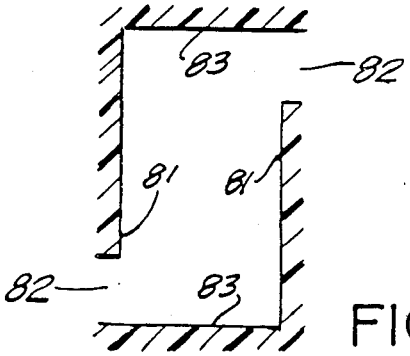
FIG. 8D is a schematic cross-section taken as indicated by the arrows 8D—8D in FIG. 6.

Referring to FIGS. 8A, 8B and 8C, each of the sidewalls 81 of each receptacle has two grooves 82 formed in, respectively, the top and bottom of the sidewalls, the depth dimension of each such groove being in the lateral direction for the head 20 of FIG. 1. In this preferred embodiment, one of the lateral walls of each groove is formed by a top or bottom planar wall 83 of the receptacle. The four grooves so formed in each receptacle 21 of FIG. 1 extend longitudinally therethrough from its rear opening, for a part of the rear to front distance of the receptacle, to shoulders 84 (FIG. 9) at which the transverse-lateral cross section of the receptacle is abruptly decreased in area so as to terminate such grooves and to form in the receptacle's interior, such lateral shoulders 84 or steps in each of the four corners of the interior of the receptacle. Over the distance from the rear of the receptacle to the shoulders, the transverse width of the grooves gradually decreases to the width of the shoulders. Accordingly, over such rear sections (see FIGS. 8B and 8C), the receptacle's cross section in transverse-lateral planes can essentially be envisaged as having the form of an "H" on its side with the center arm of the "H" being rectangular in cross section and corresponding to the main passage through the receptacle, and with the four side arms of the "H" being very small in size compared to the center arm and corresponding to, respectively, the mentioned four grooves 82. Also, in accordance with the above, the side arms of the "H" decrease in size as one proceeds from the rear towards the front of the receptacle. In the front of the shoulders formed in the receptacle's interior, the receptacle is wholly rectangular in cross section in transverse lateral planes (see FIG. 8A). It should be noted, however, that a receptacle with only two grooves can be used, especially in receptacles with larger transverse dimensions. With the larger transverse cross sections, the front of the receptacle in transverse lateral planes would still be rectangular in shape; however, in the rear of the receptacle, two of the arms in diagonally opposite corners of the "H" on its side would be missing (see FIG. 8D). In, however, both the forward and rear sections of the receptacle, the receptacle's cross-section tapers divergently in the front-to-rear direction as described.

Figure 10:
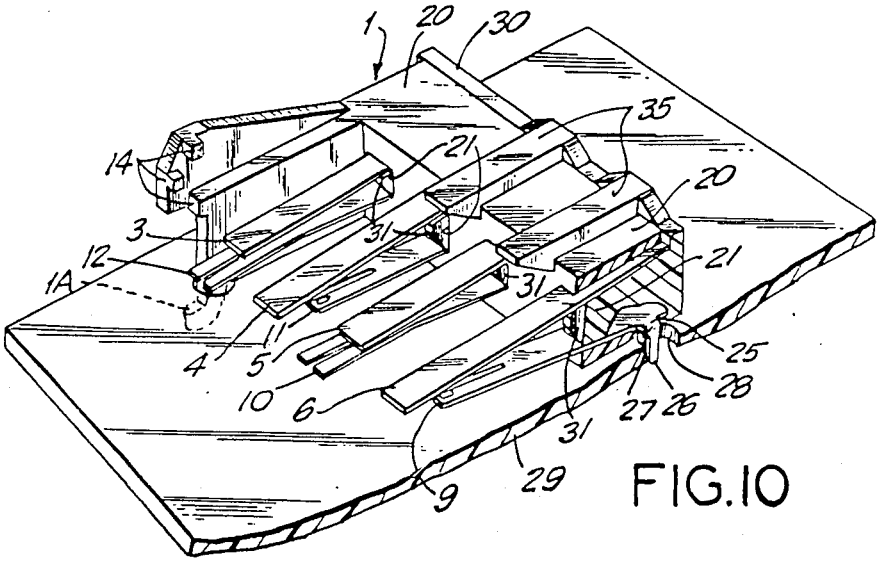
FIG. 10 shows the multiple contact switch mounted on a printed wiring board with the right side of the multiple contact switch cut away to show how the spring contacts and comb block fit into the mounting block having the receptacles.

The upper grooves (or groove) and the lower grooves (or groove) of each receptacle 21 of FIG. 1 form two guide channels for, respectively, the upper and the lower spring contacts placed in that receptacle as, for example, the spring contacts 6 and 9 (FIG. 1). As shown in FIG. 10, lower contact 9 has near its back end and on one side (a) a nib portion 25 in the plane of, and laterally salient from, the main body of the contact, and (b) a short solder tab portion 26 projecting downward from the end of nib 25 through a slot 27 extending longitudinally into head 20 from its back and passing vertically from a further enlarged back section of the right hand side (as seen in FIG. 10) of the receptacle 21 (i.e., a further lateral enlargement of such receptacle beyond the grooves) through the bottom of the head, the tab portion 26 then passing through a hole 28 in the underlying circuit board 29. The upper spring contact 6 has a similar nib on its left hand side and a similar solder tab extending downward from such nib through a slot at the left (in FIG. 10) of the receptacle. The other pairs of spring contacts are similarly constructed to have respective solder tabs passing down through slots in the head 20 and holes in the circuit board 29. It should be noted that each pair of spring contacts in this embodiment has a longer length and a shorter length. The longer length is above the shorter length if it desired to have the pair of spring contacts open when the operating card is in the rest position, and below the shorter length if it is desired to have the spring contacts closed when the operating card is in the rest position.

Figure 4:
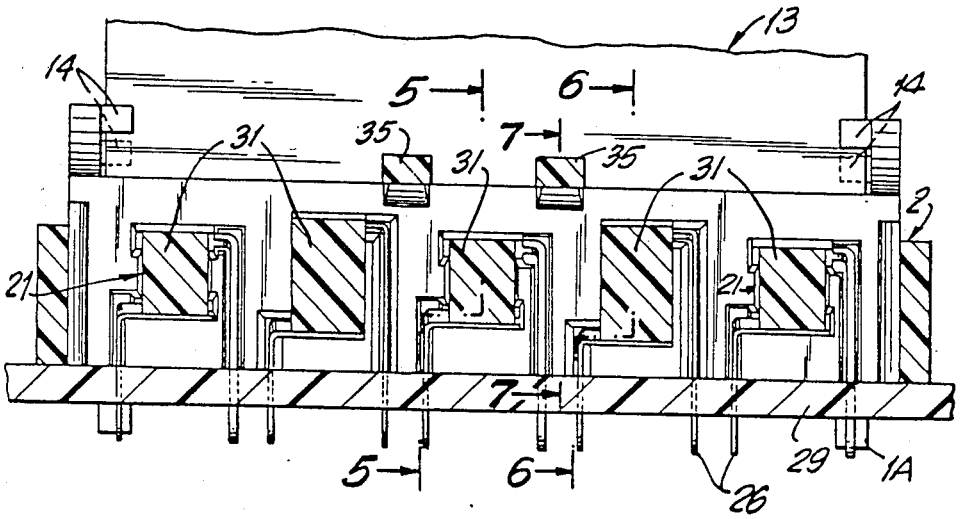
FIG. 4 is a rear elevation of the FIG. 1 apparatus, taken as indicated by the arrows 4—4 in FIG. 1.

It will also be noted that, among the various receptacles 21, (see FIGS. 4, 5 and 6) those that are designed to receive pairs of spring contacts which are open when not in contact with the operating card are of greater transverse dimension than receptacles adapted to receive pairs of contacts which are closed when not in contact with the operating card.

Again referring to FIG. 1, comb block 2 comprises a base 30 and a plurality of teeth or fingers 31 (also see FIGS. 5 and 6) longitudinally salient from base 30 and laterally spaced from each other to match the lateral same shape as the interior of the corresponding receptacle to the extent that the tooth has vertical side faces and has top and bottom faces, both the top and bottom faces of the tooth and both side faces of the tooth divergently tapering as one proceeds from the front end to the back end of the tooth. The lateral spacing between the tooth's side faces is less by a clearance than the lateral spacing between the sidewalls of the receptacle. The spacing between the top and bottom walls of the tooth is less than the spacing between the top and bottom walls of the receptacle by an amount which approximates the sum of the thicknesses of the two spring contacts associated with the receptacle.

Figure 2:
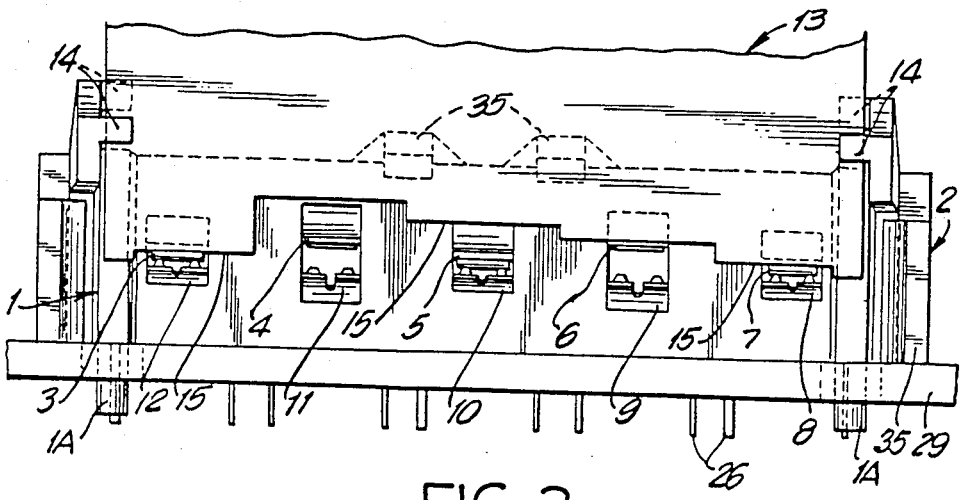
FIG. 2 is a front elevation of the FIG. 1 apparatus with an operating card thereof being in up position or rest position.
Figure 3:
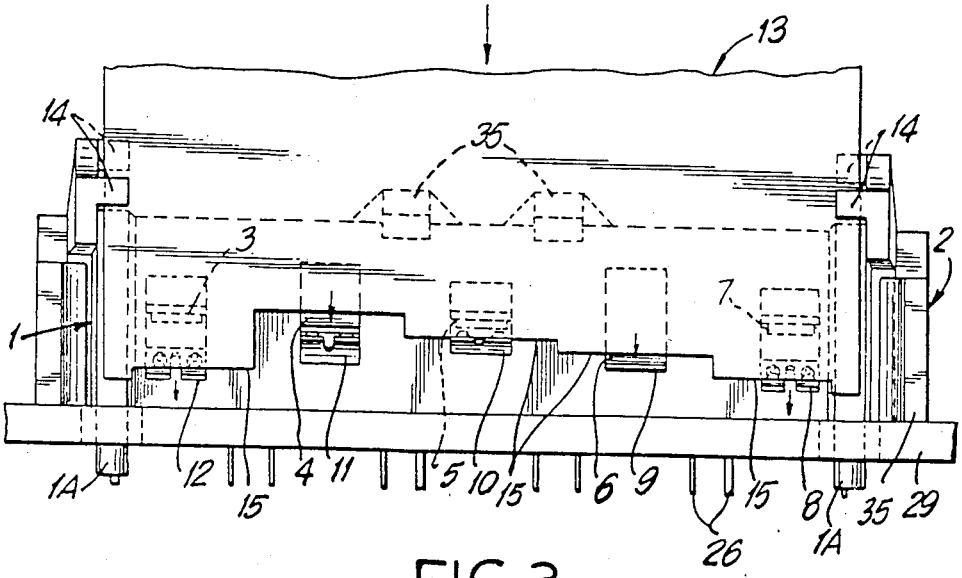
FIG. 3 is a front elevation of the FIG. 1 apparatus with such card being in down position or operating position.
Figure 5:
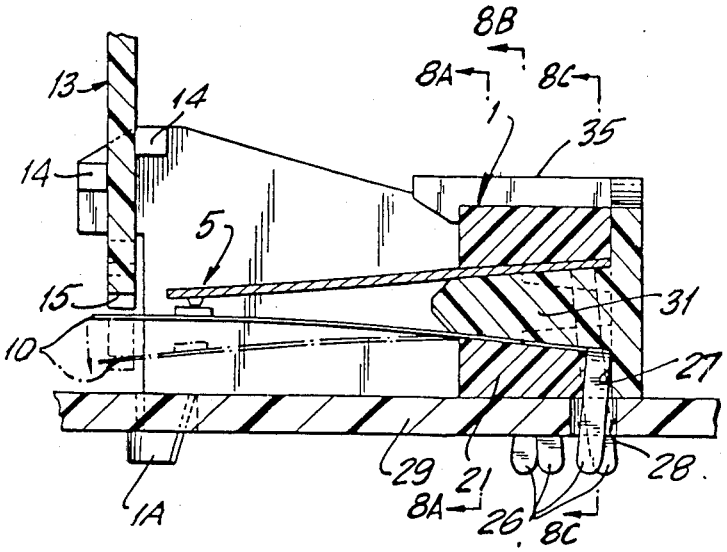
FIG. 5 is a left side elevation, in cross-section, taken as indicated by the arrows 5—5 in FIG. 4, of the FIG. 1 apparatus.
Figure 6:
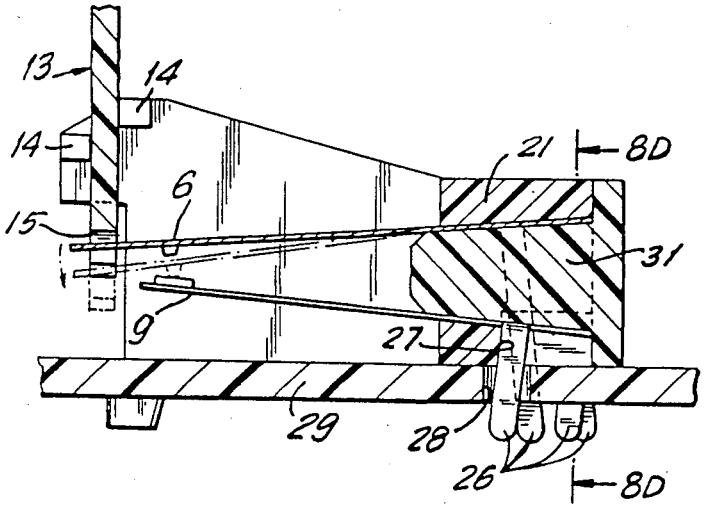
FIG. 6 is another left side elevation in cross-section, taken as indicated by the arrows 6—6 in FIG. 4 of the FIG. 1 apparatus.

Referring to FIGS. 2 and 3, operating card 13 rides in a vertical direction through guides 14 (shown in FIG. 1), and the lower lateral edge of the card engages the contact springs to either open or close them. Any desired sequence of open and/or closed spring contacts can be obtained by merely using a card with a specifically contoured lateral edge to contact and deflect the appropriate spring contacts. In this embodiment, when no contact is made with or no deflection is caused by contact with the lateral edge of the operating card (see FIG. 2); spring contact pairs 3-12, 5-10, and 7-8 are closed, and spring contact pairs 4-11, and 6-9 are open. The contact switch consisting of spring contacts 3 and 12, for example, as shown in FIGS. 3 and 5, can be opened by using an operating card whose lateral edge 15 would depress spring 12 to break its contact with spring contact 3. The bottom edge of the operating card can also be contoured so that the pairs of contact springs can be opened or closed at different times during the time interval in which the operating card is moving from the rest position to the operating position. For example, in FIGS. 2 and 3, spring contact pair 3-12 will open before spring contact pair 5-10 will open.

The spring contacts can be made of any conductive metallic material of any thickness having sufficient resiliency to return the operating card to an original or rest position when pressure on said spring contacts is released. In the original or rest position, the spring contacts are in the same sequence of open and closed positions as if no operating card were used (see FIG. 2). Such release can occur, for example, when a receiver on a telephone set is taken off the hook and an elastic force from the spring contacts resulting from a prior displacement of the spring contacts returns the card to the original or rest position. In this particular embodiment, the spring contacts are made of a phospor bronze material with a thickness of about five to six mils.

Figure 7:
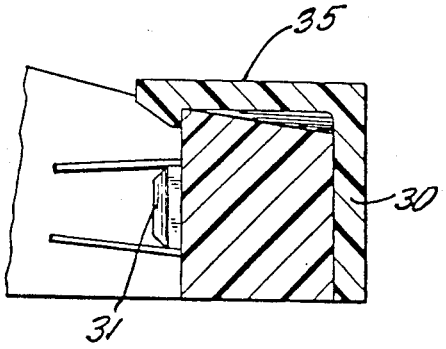
FIG. 7 is a side elevation in cross-section, taken as indicated by the arrows 7—7 in FIG. 4 of a rear part of the FIG. 1 apparatus.
Figure 9:
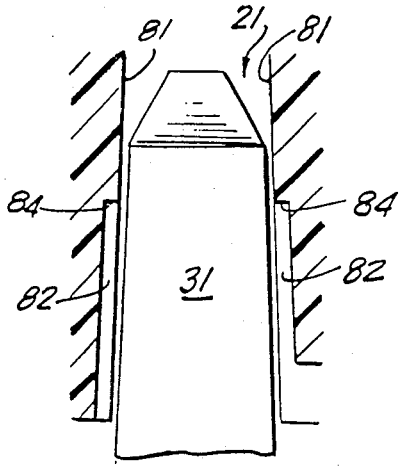
FIG. 9 is a top sectional view of the receptacle in a plane parallel to the top surface of the tooth with the upper spring contact removed and the tooth inserted.

Referring to FIGS. 1 and 10, mounting block 1, the spring contacts and comb block 2 are assembled as follows. The mounting block is tilted 90° so that the back end of its head 20 faces upwards. The two spring contacts associated with each receptacle 21 are then dropped, front end first, into the two channels provided therefor (as earlier described) by the four grooves (or two grooves) in the receptacle's interior. Downward motion of the contacts within the receptacle is stopped by the coming into engagement of the nibs 25 on the contacts with the mentioned shoulders or steps formed in the receptacle's interior. The contacts are adjusted to pass the solder tabs 26 thereon through the appropriate slots 27 in the head. The spring contacts are now held somewhat loosely in their channels. Next, comb block 2 is moved downward relative to mounting block 1 to advance the comb block or fingers 31 into the corresponding receptacles 21 in the head 20. When this is done, the top and bottom faces of the teeth wedgingly engage with the upper and lower spring contacts in the receptacles to fix the relative positions of the contacts in each pair thereof so that each of the two contacts in each pair have the desired transverse spacing and angular tilt relative to each other (see FIGS. 5 and 6). A top view of the receptacle with the tooth inserted is shown in FIG. 9. At the end of the movement of the teeth 31 into receptacles 21, locking tabs 35 (see FIGS. 1 and 7) on the comb block 2 snap into engagement with the front face of and the two side faces of head 20 to hold the comb block 2 clamped to the mounting block 1.

The comb block and mounting block assembly can then be attached to the printed wiring board 29 of FIG. 10 by hooking feet (see 1A of FIG. 10) into the printed wiring board, passing the solder tabs (like tabs 26 of FIG. 10) into holes (like holes 28 of FIG. 10) in the printed wiring board and then soldering the solder tabs to the printed wiring board. An operating card like that described above can then be inserted to open or close the switching elements or springs.

What is claimed is:

1. An electric contact switch comprising:

insulative contact mounting means having a tapered aperture formed therein that extends longitudinally therethrough from front to back thereof, the aperture having top and bottom planar walls that face one another and diverge from one another in moving from the front to the back of the contact mounting means;

a pair of longitudinally elongated leaf spring contact members, each having a main body portion that is substantially planar and is adapted at one end to make electrical contact with the corresponding end of the other leaf spring contact member, the other end of the main body portion of the leaf spring contact members being respectively positioned in engagement with the top and bottom walls of the aperture of the contact mounting means, each leaf spring contact member further having a terminal portion for making electrical connection to the leaf spring contact member, the terminal portion extending from the main body portion;

a dielectric tapered member that is positioned within the aperture between the main body portions of the leaf spring contact members to hold the main body portions of the leaf spring contact members in place and press the other ends of the main body portions against the top and bottom walls of the aperture and thereby orient the leaf spring contact members so that they converge toward one another in moving toward the one end.

* * * * *